United States Patent [19]

Grubman

[11] Patent Number: 4,694,509

[45] Date of Patent: Sep. 22, 1987

[54] NON-PUCKER NECKTIE

[76] Inventor: Moe M. Grubman, 99-32/66 Road, Rego Park, N.Y. 11374

[21] Appl. No.: 777,767

[22] Filed: Sep. 19, 1985

[51] Int. Cl.[4] ..... A41D 25/06

[52] U.S. Cl. ..... 2/144; 2/146

[58] Field of Search ..... 2/144, 146

[56] References Cited

U.S. PATENT DOCUMENTS

| | | | |
|---|---|---|---|
| 1,599,950 | 9/1926 | Blanchard | 2/146 |
| 1,782,183 | 11/1930 | Strauss | 2/146 |
| 1,906,120 | 4/1933 | Waltz | 2/146 |
| 1,916,507 | 7/1933 | Green et al. | 2/146 X |
| 2,085,914 | 7/1937 | Lucas | 2/146 |
| 2,269,577 | 1/1942 | Brohard | 2/146 |
| 2,371,947 | 3/1945 | Benson | 2/146 |
| 3,562,814 | 2/1971 | Ackerman | 2/146 |
| 3,657,743 | 4/1972 | Bucci | 2/146 |
| 3,744,057 | 7/1973 | Luceri | 2/146 |
| 4,506,389 | 3/1985 | Franklin | 2/144 |

*Primary Examiner*—Louis K. Rimrodt
*Attorney, Agent, or Firm*—William T. Hough

[57] ABSTRACT

In a preferred embodiment, a necktie and method of making, inclusive of outer ornamental material and a wool or wool-containing lining, the outer ornamental material and the wool lining being pieces cut on the same pattern tied-together adjacent their edges by hand slip stitches when they are in an overlayed state and position relative to each other for their corresponding shapes characterized by non-wrinkled state devoid of pucker in the stitched state, the slip stitches preferably not passing through the final front face of the necktie's outer ornamental material by virtue of a flexible removable cardboard, leather or plastic member of a shape of the final front face inserted between overlapped folded outer ornamental and wool lining materials during the hand-stitching thereof followed by slipping-out the flexible member after completion of stitching.

10 Claims, 19 Drawing Figures

NON-PUCKER NECKTIE

This invention is directed to a novel non-puckered necktie and method of making it.

BACKGROUND

Prior to the present invention there have been many products on the market fraudulently identifying themselves as hand-made ties, such hand-made neckties being normally for the legitimate thing characterized by being carefully made and cut and sewn to avoid the conventional puckering and/or wrinkling incurred in the final product of typical machine-made neckties. The machine-made neckties having a wool or wool-containing lining have such problems, as well as requiring and/or using different sized pattern forms for the cutting of the exterior ornamental material as compared to the narrower lining piece when cut. Also, the time required for hand slip-stitching while avoiding piercing the final front face of the necktie's outer ornamental material, is excessive because of the extensive care required to avoid such undesirable effect, or result.

OBJECTS OF THE INVENTION

The objects of the present invention include the overcoming of one or more difficulties and/or problems of the nature discussed-above, together with producing a quality necktie at reduced cost and lower sales price to the consumer.

Another object is to obtain a tie of necktie type, having improved and thicker "feel", with more body sturdy against undesirable wrinkling and/or flipping-about.

Another object is to obtain a tie in which the wool or wool-containing lining thereof, is appropriately anchored during and after stitching by slip stitches, up to the edges of the folds at the edges of the final front face of the necktie's outer ornamental material.

Another object is to obtain an article making possible such edge-anchoring and speedy slip stitching neatly devoid of undesirable piercing of the final front fact of the necktie's ornamental material.

Another object is to obtain a novel necktie of which slip-stitches piercing the final front face of the necktie constitute a functional and ornamental purpose concurrently, improving the durability and appearance of the necktie.

Other objects become apparent from the following disclosure.

One or more objects above-stated are obtained by the invention described above and hereinbelow, and as herein claimed.

SUMMARY OF THE INVENTION

Broadly there are included three separate areas of invention, namely (1) a method of making a necktie, (2) a stitching article in the nature of an apparel apparatus, and (3) a necktie.

The method of making a necktie broadly includes the steps as follow:

1. By a common pattern form, cutting to identical and corresponding shapes and dimensions each of a necktie outer material, and the lining that is made preferably substantially of wool;
2. Using the above-noted outer material and the lining, a above-cut to identical shapes and dimensions, the outer material and lining are thereafter superimposed one on the other superimposing the lining on a flat and matched rearward face of the outer material;
3. Thereafter, at least one edge of each of the outer material and the lining material are both substantially concurrently folded rearwardly along a predetermined fold line, into a folded state such that there results at least one folded portion;
4. Thereafter, stitch the folded portion in such a manner that the folded portion is retained in the folded state.

In a preferred method, prior to the above-noted third step, there is an additional step of placing onto a rearward flat face of the superimposed lining an elongated strip of substantially impervious material having shape and dimensions corresponding to the width and length dimensions of a final front fact portion that will result after the above-noted third step of folding rearwardly. Also in this preferred method, following the above-noted fourth step, the elongated strip is thereafter withdrawn at one end of the overlapped portion from therebeneath.

A second aspect of the overall invention, as noted in the preceding description of the method, is the stitching article, namely the above-noted elongated strip of substantially impervious material that has the shape and dimensions corresponding to the desired width and length dimentions of a final product to be produced by the above-described preferred method.

The third area of invention is the necktie product itself. The necktie may be characterized as follows. The outer material is ornamental and has desired predetermined width and length dimensions as measured before having been folded to its folded-over state. In the folded state, the rearwardly folded edge(s) thereof are overlapped. A lining thereof preferably predominantly of wool, has width and lenght and shape dimensions substantially identical to that of the above-noted ornamental outer material. The lining material prior to the folding of the outer material, is in a superimposed state with the matching corresponding shape of the outer material flushly upon a rearward face of the outer material. In the folded state, at least one edge of both the outer material and the lining are jointly folded rearwardly onto itself and are jointly stitched in the folded state. In one preferred embodiment, both of opposite edges are folded toward each other and are in an overlapped state, and stitched in that overlapped state. In another preferred embodiment, each of the outer material and the lining are shaped as two side-by-side front-face shapes, and jointly folded-over at a fold point therebetween upon themselves and are in a stitched state in that form, resulting in the tie having each of opposite outer faces exhibiting the outer ornamental material such that the tie is reversible in the sense that either face thereof may alternately be utilized as the exhibited front face. In various one of the aforementioned embodiments, the tie preferably in its folded state embodies stitches of the slip-stitches type; in one or more of such embodiments, the slip stitch extends through and is visible to the eye on the face of the outer ornamental material and constitutes a part of the ornamental aesthetically appealing appearance of the tie.

The finer neckties are set-apart as a distinct class or catagory, by the wool or wool-containing lining which adds bulk, stiffness and quality "feel" to the finished necktie, together with improving the appearance of the stitched outer ornamental material. However, as discussed in the preceding background, puckering and wrinkles appear along the edges of the final front portion of the cheap ties manufactured (non-hand-made) even with such including the hand stitching. The present invention avoids the problem of the lining not extending to the circumscribing edges of final front portions, by having the lining cut to a width sufficiently wide as to be folded rearwardly together with the rearward folding of the edges of front ornamental material whereby wrinkles and puckering are obviated. Additionaly, costly, slow hand slip-stitching is avoided by improved speed to rapid hand slip-stitching by use of a novel elongated needle-impervious flexible strip having a width approximately the same as the width of the final front portion of the tie to be shaped thereon. The cost of manufacture and production is further reduced by cutting the outer ornamental material and the lining material on the same pattern form, such that the cut outer material and lining material have corresponding shapes, are concurrently folded rearwardly and are stitched through the folded thickness of both by the hand slip-stitches.

Optionally as might be desireable the outer material and lining folded rearwardly are hand-stitched through also the necktie's final front portion to give a special ornamental appearance of any of various optional designs.

In another variation on the invention, the outer material and the preferred wool or wool-containing lining are each cut substantially identically to the other, cut of a shape corresponding to two side-by-side joined front-shaped portions each shaped as a final necktie's front exposed portion. Thereby, with the lining superimposed on the outer material, both are folded rearwardly along a fold-line extending longitudinally axially of the tie's length between the front-shaped portions. Thereafter, the folded front-shaped portions are hand slip-stitched together along free-edges thereof and optionally also adjacent the fold-line. Optionally the hand slip-stitching may extend all the way or may not through both front-shaped portions. Thusly, a reversible tie is produced, i.e. either side may be utilized as the front or turned-over if the forward-facing portion accidentally becomes soiled.

Accordingly, by the novel inventive method, there are the steps of 1. cutting each neckties ornamental outer material and lining preferably wool or wool containing material, by a substantially common pattern to form substantially-identical and substantially corresponding shapes and dimensions. The preferred lining is composed pimarily or entirely of wool. 2. Next, the method includes superimposing the lining material, as cut, on a flat and shape-matched rearward face of the neckties outer material. Optionally but preferably thereafter the method includes the step 3. of placing onto a rearward flat face of its superimposed lining, an elongated substantially needle-impervious flexible strip having a shape and width dimensions corresponding substantially to predetermined final front face dimensions of a necktie's final front portion that remains after side portion(s) of the tie materials are folded rearwardly. 4. The necktie's outer material and the superimposed lining material are concurrently folded rearwardly along the predetermined fold-line(s) that correspond to the side-edge(s) of the final front face with dimensions of the necktie's final front portion. After the rearward-folding, the method includes 5. slip stitching folded, preferably overlapped portions. Thereafter the method includes 6. withdrawing the elongated needle-impervious strip. The finished tie is pressed appropriately.

Accordingly, there is produced a necktie having necktie outer ornamental material of predetermined width and length dimensions as measured prior to a folding and rearwardly overlapping of opposite width-edges thereof. The lining material preferably of wool or a majority thereof being of wool, is of a shape and has width and length dimensions substantially identical to that above-noted for the outer ornamental material. The lining material is superimposed flushly upon a rearward face of the cut, shaped necktie's ornamental outer material, positioned thereon such that corresponding width and length shapes substantially match and correspond. Opposite edges of the outer material and the lining material are in a state of being folded rearwardly, preferably overlapped and of being stitched together preferably with slip stitches in preferred embodiment, the stitches extend ornamentally through the necktie's exposed visible front portion in any desired ornamental design.

In a further preferred embodiment, either face of the completed tie may be utilized as the front portion, as a result of the preferred method described-above in which each cut design of the respective outer material and the lining material, includes substantially identical left and right front and back shape seperated by a substantially axially-extending imaginary fold-line therebetween. As above-noted, the lining material is preferably of wool, or contains at-least a majority of wool. With the lining material superimposed behind the outer ornamental material, the necktie is in a state of one of the left and right portions of each of the outer material and superimposed lining material, being folded-back upon itself (themselves) and stitched, preferably hand slip-stitched. The stitches may optionally extend all the way through forward and rearward faces of the folded outer material to be visible as any of optional designs ornamentally.

The outer material is the necktie ornamental materials and is typically of material such as silk, cotton, wool, synthetic fiber, or mixtures thereof. The invention may be better understood by making reference to the accompanying Figures.

THE FIGURES

FIG. 1. FIGS. 1 through 3 illustrate views at progressive stages in a method of making a necktie, FIGS. 1A, 1B, 1C, 2A, 2B, 3A, and 3B showing crossection thereof.

FIG. 1 illustrates diagramatic plan exploded elevation views of the outer material with sewn-on pockets at opposite ends, and the wool lining material, and also, illustrating the elongated needle-impervious strip in position, a narrowed end of the strip being within the bottom pocket, in the superimposed state, the lining is positioned with each of opposite ends thereof within the respective sewn on pockets at the opposite ends of the outer material.

DETAILED DESCRIPTION

For corresponding elements or parts of different Figures, identical or similar indicia are utilized to improve ease of understanding. Once described, portions description will not be repeated normally.

Figure 1:
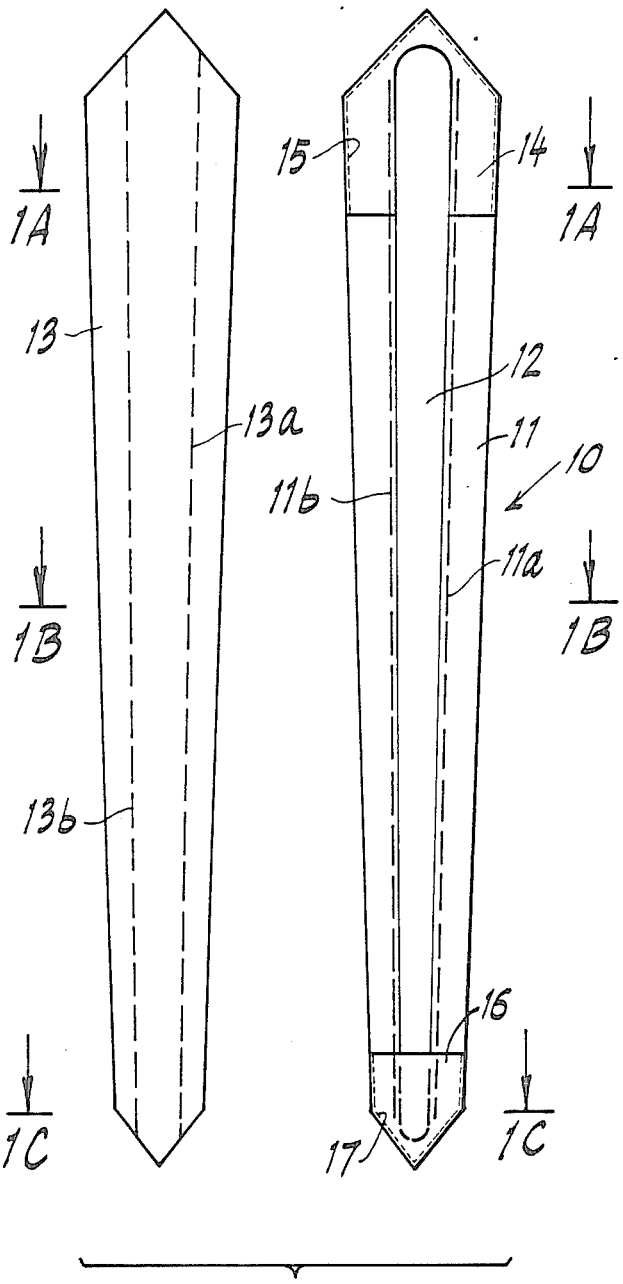
FIG. 1A illustrates the combination of FIG. 1 in the superimposed state, and with the mounted elongated strip, as taken along line 1A—1A of FIG. 1.
FIG. 1B illustrates the combination of FIG. 1 in the superimposed state, and with the mounted elongated strip, as taken along line 1B—1B of FIG. 1.
FIG. 1C illustrates the combination of FIG. 1 in the superimposed state, and with the mounted elongated strip, as taken along line 1C—1C of FIG. 1.
Figure 1A:
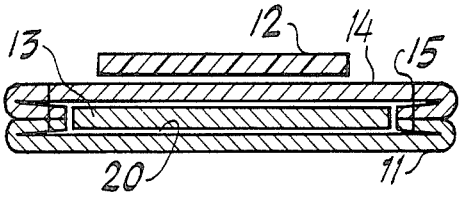
Figure 1B:
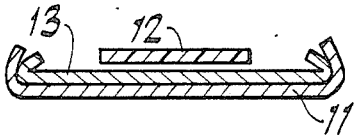
Figure 1C:
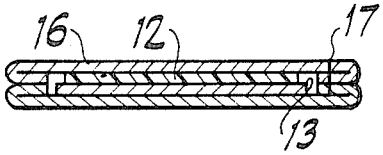

In FIG. 1, for necktie 10, the rearward-face of the outer material 11 is shown having sewn-on pockets 14 and 16, with elongated strip 12 inserted in the lower pocket 16, and lining material 13 that is inserted beneath the elongated strip 12 within the sewn-on pockets 14 and 16. Pocket stitches 15 and 17 are shown. Rearward imaginary fold lines are shown at 11*a*, 11*b*, 13*a* and 13*b*. FIGS. 1A, 1B, and 1C illustrate corresponding parts.

Figure 2:
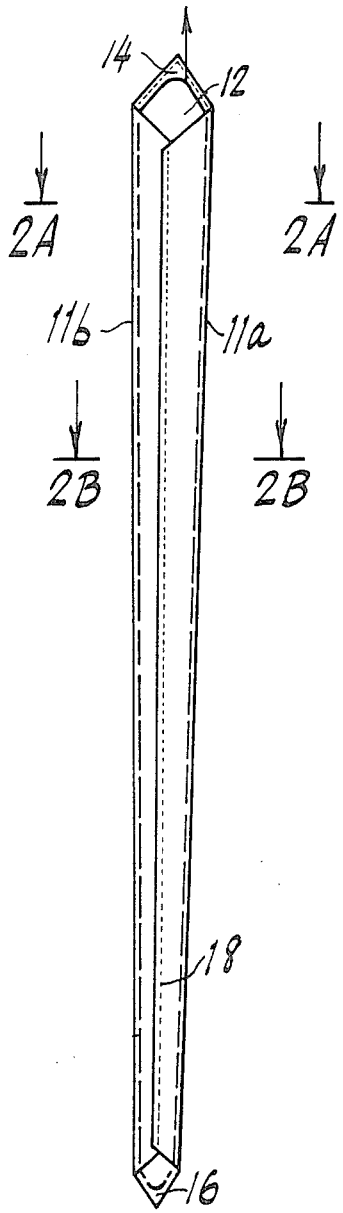
FIG. 2 illustrates the same view as FIG. 1, except after the folding rearwardly and stitching of each of the opposite width-edges, with the elongated strip still inserted after the stitching of the overlapped portions thereof.
Figure 2B:
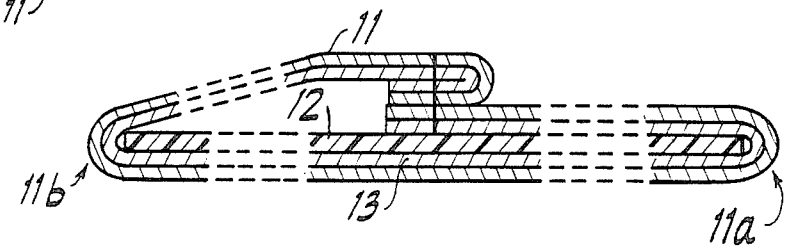
FIG. 2B illustrates the view of FIG. 2 along line 2B—2B of FIG. 2.
Figure 2A:
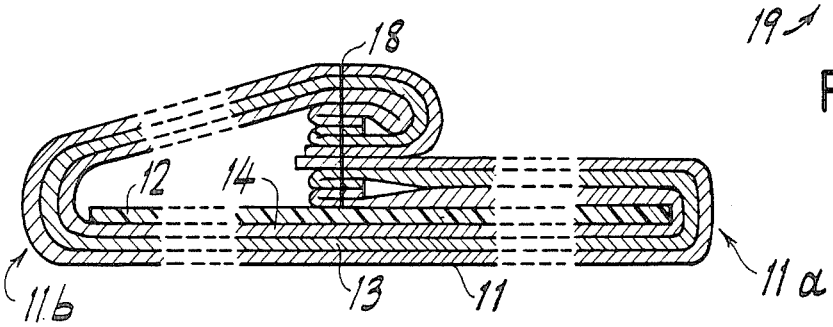
FIG. 2A illustrates the view of FIG. 2 along line 2A—2A of FIG. 2.

FIG. 2 illustrates the same FIG. 1 combination, after the rearwardly folding and stitching of opposite width-edges at fold points 11*a* and 11*b*, for example. The arrow shown at the upper end of the elongated strip, shows the direction of withdrawal of the elongated strip 12. Stitching 18 are shown, stitching the overlapped rearwardly folded edges. FIGS. 2A and 2B show corresponding parts.

Figure 3B:
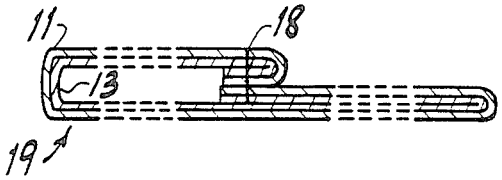
FIG. 3B illustrates a view along line 3B—3B of FIG. 3.
Figure 3A:
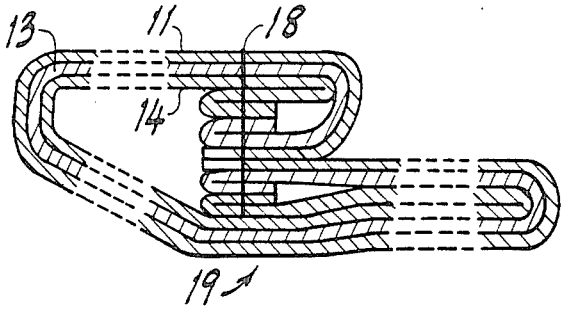
FIG. 3A illustrates a view along line 3A—3A of FIG. 3.
Figures 3, 4, 5:
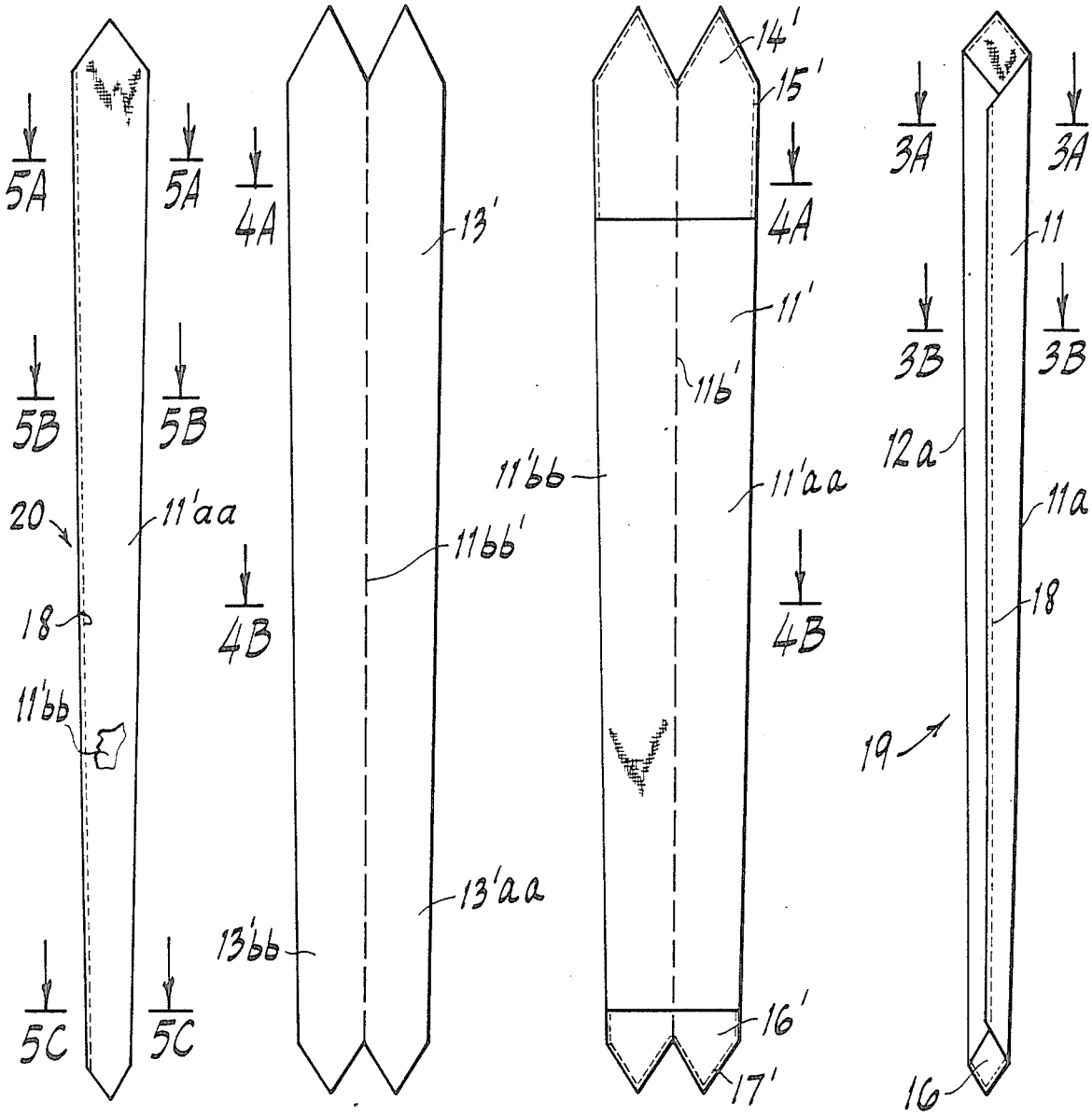
FIG. 3 illustrates the same view as FIG. 2 except with the elongated strip having been withdrawn.
FIG. 4 illustrates in exploded view, an alternate embodiment in elevation plan view.
FIG. 5 illustrates an alternative embodiment taken in exploded elevation plan view, showing the outer material with sewn-on pockets at each of opposite ends thereof, and the seperate lining material, opposite ends of the lining material being inserted within the sewn-on pockets, with partial cut-away.
Figure 4A:
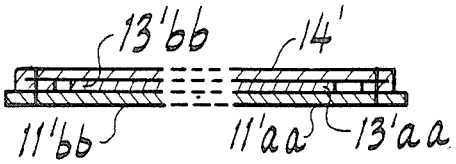
FIG. 4A illustrates a view taken along line 4A—4A of FIG. 4.
Figure 4B:
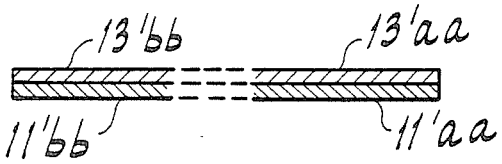
FIG. 4B illustrates a view taken along line 4B—4B of FIG. 4.
Figure 5A:
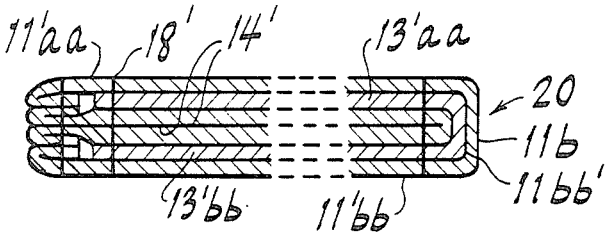
FIG. 5A illustrates a view as taken along each of lines 5A—5A and 5C—5C respectively of FIG. 5.
Figure 5B:
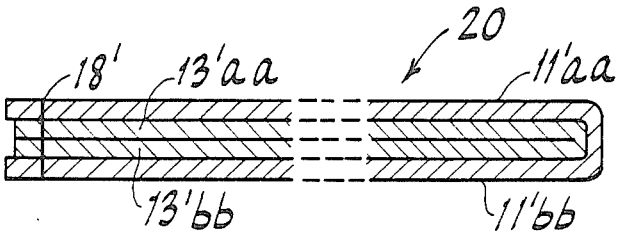
FIG. 5B illustrates a view as taken along line 5B—5B of FIG. 5.

In each of FIGS. 2A and 3A respectively, for respectively the line 2A—2A of FIG. 2 and the line 3A—3A of FIG. 3, there is shown a view in cross-section through the folded ties at the position of the pocket 14, illustrating the edges thereof folded-over with appropriate stitching. In the FIG. 2A embodiment, the cross-section of the inserted strip 12 is also there shown. In FIG. 2B, the relationships shown are identical to that of FIG. 2A, except that the cross-sectional view is taken at a point (location) intermediate between the pockets at opposite ends of the tie.

FIG. 3 illustrates the same elements as FIG. 2 except after withdrawal of the elements of FIG. 2.

FIGS. 3A and 3B illustrate the same elements as FIG. 3.

The cross-sectional relationships as taken along line 3A—3A of FIG. 3, are substantially identical to those shown for the FIG. 2A, except that the elongated strip 12 has been withdrawn already from the illustrated embodiment of FIG. 3.

FIG. 4 illustrates a rearward view of the outer material 11' of an alternate embodiment with sewn on pockets, 14' and 16', in exploded view, with lining 13', the lining 13' being superimposed on outer material 15 within the pockets 14' and 16', showing stitching 15' and 16' and imaginary fold-lines 11*b'* and 11*bb'*, for connected portions 11'*aa*–11'*bb* and 13'*aa*–13'*bb* respectively.

FIG. 5 shows the same necktie 20 of FIG. 4 after folding, showing stitches 18, in its completed state, and lining 11'*bb* at the cut-away.

Figure 6:
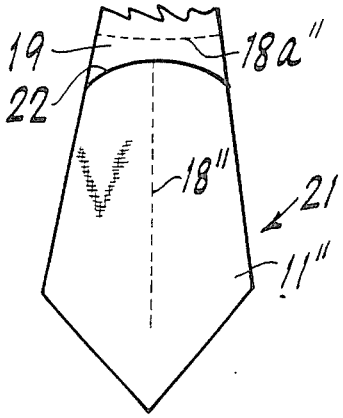
FIG. 6 illustrates diagrammatically an in-part view of an ornamentally-stitched necktie having ornamental stitches on the final front portion, having an optional upper portion with overlapped pocket-forming portion in elevation plan front view.

FIG. 6 illustrates diagrammatically an in-part view of an ornamentally-stitched necktie 21 having ornamental stitches 18'' and 18*a''* on the final front portion 11'', having an optional upper portion 19 with over-lapped pocket-forming portion 22 in elevation plan front view.

Figure 7:
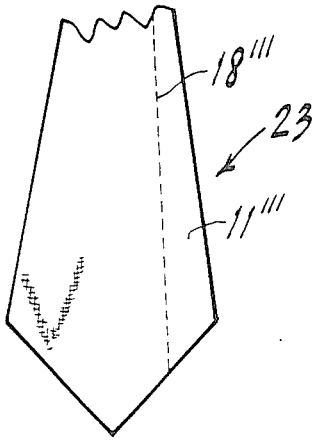
FIG. 7 illustrates diagramatically an in-part view of another ornamentally stitched necktie with an off-set line of ornamental stitches in elevation plan front view.

FIG. 7 illustrates diagramatically an in-part view of another ornamentally stitched necktie 23 with an off-set line of ornamental stitches 18''' a necktie face 11''' in elevation plan front view.

Figure 8:
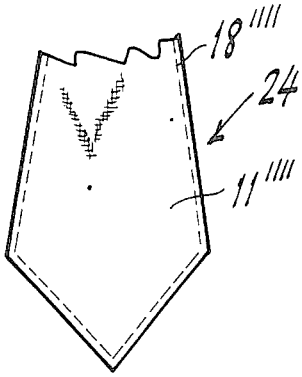
FIG. 8 illustrates diagramatically an in-part view of another ornamentally stitched necktie with a circumscribing line of stitches, in elevation plan front view.

FIG. 8 illustrates diagramatically an in-part view of another ornamentally stitched necktie 24 with a circumscribing line of stitches 18''' in elevation plan front view.

The method thus includes the steps of (1) cutting each of the necktie outer material and the lining material by a pattern form of substantially identical and corresponding shapes and dimensions; and (2) superimposing the lining such as 13 onto a flat and matched rearward face (as typically shown in FIG. 1, superimposed in FIG. 2 as shown) of necktie outer material (ornamental material 11, and 3) folding rearwardly the lining material 13 and the rearward face concurrently along at least one predetermined fold line (fold lines 11*a* and 11*b*, for example), and thereafter stitching the folded portion to be retained in the folded state as shown typically in FIG. 2.

No relevant prior art was discovered during a patentability search. Typical patent include: Dombrowsky U.S. Pat. No. 2,024,151 that illustrates a two front tie with one common central lining; and Campagnoli U.S. Pat. No. 2,174,966 disclosing a conventionally-positioned and cut lining of cotton, cut on a bias; and Cohan U.S. Pat. No. 2,656,543 having a long main lining together with another short inner lining both as the tie lining, each of a width corresponding to the width of a finished tie; and Berendensen U.S. Pat. No. 2,682,663 having a thick main lining and another end-lining; and Ackerman U.S. Pat. Nos. 3,562,814 and 3,426,360 each and both having lining of widths corresponding to a width of a finished tie, each and both having sewn-together layered lining of substantially corresponding widths and lengths; and Elgin U.S. Pat. No. 1,962,437 disclosing an invertible tie or various designs and shapes.

I claim:

1. A necktie comprising in combination, a necktie outer ornamental material of predetermined width and length dimensions prior to a folding and rearward overlapping of opposite edges thereof, a woolen-type continuous lining material of shape with width and length dimensions substantially identical to said necktie outer ornamental material of predetermined width and length dimensions, and said lining material beng superimposed flushly upon a rearward face of necktie outer ornamental material positioned thereon such that corresponding width and length shapes substantially correspond, and opposite edges of the outer ornamental material and the lining material being at side edges thereof folded rearwardly and overlapped and slip-stitched together with stitches.

2. A necktie of claim 1, in which said stitches are slip-stitches.

3. A necktie of claim 2, in which said stitches extend through a remaining front face portion of said necktie outer ornamental material and are visible on the remaining front face portion between fold-lines of rearwardly folded edges, visible as visible stitching.

4. A necktie of claim 3, in which said stitching anchors-together rearwardly folded portions of the outer ornamental material, the lining thereof, together with forward lining material and the remaining front portion of said necktie outer ornamental material, while concurrently forming aesthetically appearing design on said remaining front face portion, as ornamental stitching.

5. A necktie consisting essentially of: an outer material and a woolen-type continuous lining material both having width and length dimensions cut and shaped substantially identically to shapes each corresponding to two adjacent side-by-side cut-front-portions, each cut front portions being substantially of dimensions of a final necktie's front portion, the outer material and lining material being superimposed on top of the lining material, and superimposed portions of one of said cut-front-portions being folded rearwardly upon the other cut portions and being stitched by stitches in the folded-state.

6. A necktie of claim 5 in which said lining consists essentially of at least predominately wool.

7. A necktie of claim 5 in which said stitches are slip-stitches.

8. A necktie of claim 5 in which said stitches extend through each of front and rearward folded said cut-front-portions as visible ornamental design.

9. A necktie comprising in combination, a necktie outer ornamental material of predetermined width and length dimensions prior to a folding and rearward overlapping of opposite edges thereof, a woolen-type continuous lining material of shape width and length dimensions substantially identical to said necktie outer ornamental material of predetermined width and length dimensions, and said lining material being superimposed flushly upon a rearward face of necktie outer ornamental material positioned thereon such that corresponding width and length shapes substantially correspond, and opposite edges of the outer ornamental material and the lining material being at said edges thereof folded rearwardly and stitched with stitches.

10. A necktie of claim 9, in which said stitches are slip-stitches.

* * * * *